US008051653B2

(12) United States Patent
Hsu et al.

(10) Patent No.: US 8,051,653 B2
(45) Date of Patent: Nov. 8, 2011

(54) VELOCITY-PRESSURE CONTROL APPARATUS OF HYDRAULIC MACHINE

(75) Inventors: Ko-Liang Hsu, Taipei Hsien (TW); Hsing-Chang Liu, Taipei Hsien (TW)

(73) Assignee: Foxnum Technology Co., Ltd., Tu-Cheng, New Taipei (TW)

( * ) Notice: Subject to any disclaimer, the term of this patent is extended or adjusted under 35 U.S.C. 154(b) by 553 days.

(21) Appl. No.: 12/334,539

(22) Filed: Dec. 15, 2008

(65) Prior Publication Data

US 2010/0126162 A1 May 27, 2010

(30) Foreign Application Priority Data

Nov. 21, 2008 (CN) ..... 2008 1 0305683

(51) Int. Cl.
*F16D 31/02* (2006.01)
*F04B 49/06* (2006.01)

(52) U.S. Cl. ..... 60/431; 417/44.2

(58) Field of Classification Search ..... 60/431, 60/449, 452; 417/1, 44.1, 44.2
See application file for complete search history.

(56) References Cited

U.S. PATENT DOCUMENTS

| | | | | |
|---|---|---|---|---|
| 5,971,714 | A * | 10/1999 | Schaffer et al. | 417/44.2 |
| 6,074,170 | A * | 6/2000 | Bert et al. | 417/44.2 |
| 6,748,739 | B1 * | 6/2004 | Hirano et al. | 60/431 |
| 6,994,537 | B2 * | 2/2006 | Liu et al. | 425/143 |
| 2009/0097986 | A1 * | 4/2009 | Nakata et al. | 417/44.2 |

* cited by examiner

*Primary Examiner* — Michael Leslie
(74) *Attorney, Agent, or Firm* — Altis Law Group, Inc.

(57) ABSTRACT

A velocity-pressure control apparatus of a hydraulic machine includes a pressure command generator, a pressure sensor, a pressure controller, a velocity command generator, a velocity limiter, a switch, a comparator, a velocity sensor, and a motor driver. The pressure controller receives a pressure compensation signal composed by the pressure command generator and the pressure sensor. The velocity limiter receives a compensation velocity signal from the pressure controller and a predetermined velocity signal from the velocity command generator and outputs a corresponding limiting velocity command signal to the switch. The comparator controls the velocity-pressure control apparatus to work at a velocity control mode when the pressure compensation signal is a positive signal or a null signal, and controls the velocity-pressure control apparatus to work at a master pressure control and slave velocity control mode when the pressure compensation signal is a negative signal.

5 Claims, 2 Drawing Sheets

VELOCITY-PRESSURE CONTROL APPARATUS OF HYDRAULIC MACHINE

BACKGROUND

1. Technical Field

The present disclosure relates to control apparatuses, and particularly to a control apparatus for controlling motor velocity and hydraulic pump pressure of a hydraulic machine.

2. Description of Related Art

Hydraulic machines, such as hydraulic injection molding machines, are operated by hydraulic pumps controlled by motors. Motor velocity and hydraulic pump pressure are controlled by a control apparatus to make moveable elements of the injection molding machine work. Generally, product engineers manually adjust velocity and pressure according to experience, which may not be accurate and is inconvenient.

What is needed is to provide a velocity-pressure control apparatus of a hydraulic machine to overcome the above-described shortcomings.

DETAILED DESCRIPTION

Figure 1:
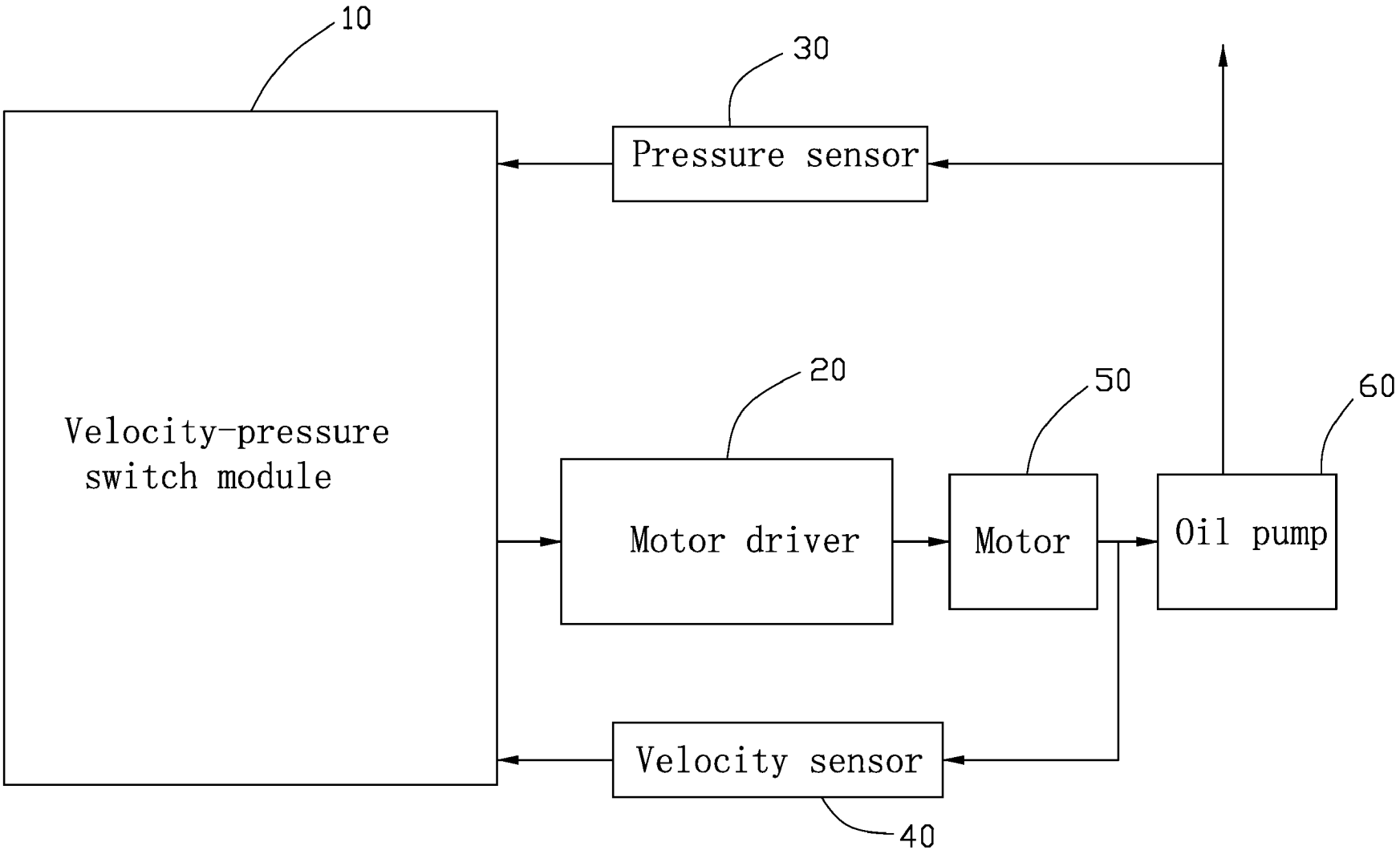
FIG. 1 is a block diagram of an exemplary embodiment of a velocity-pressure control apparatus of a hydraulic machine, together with a motor and an oil pump.
Figure 2:
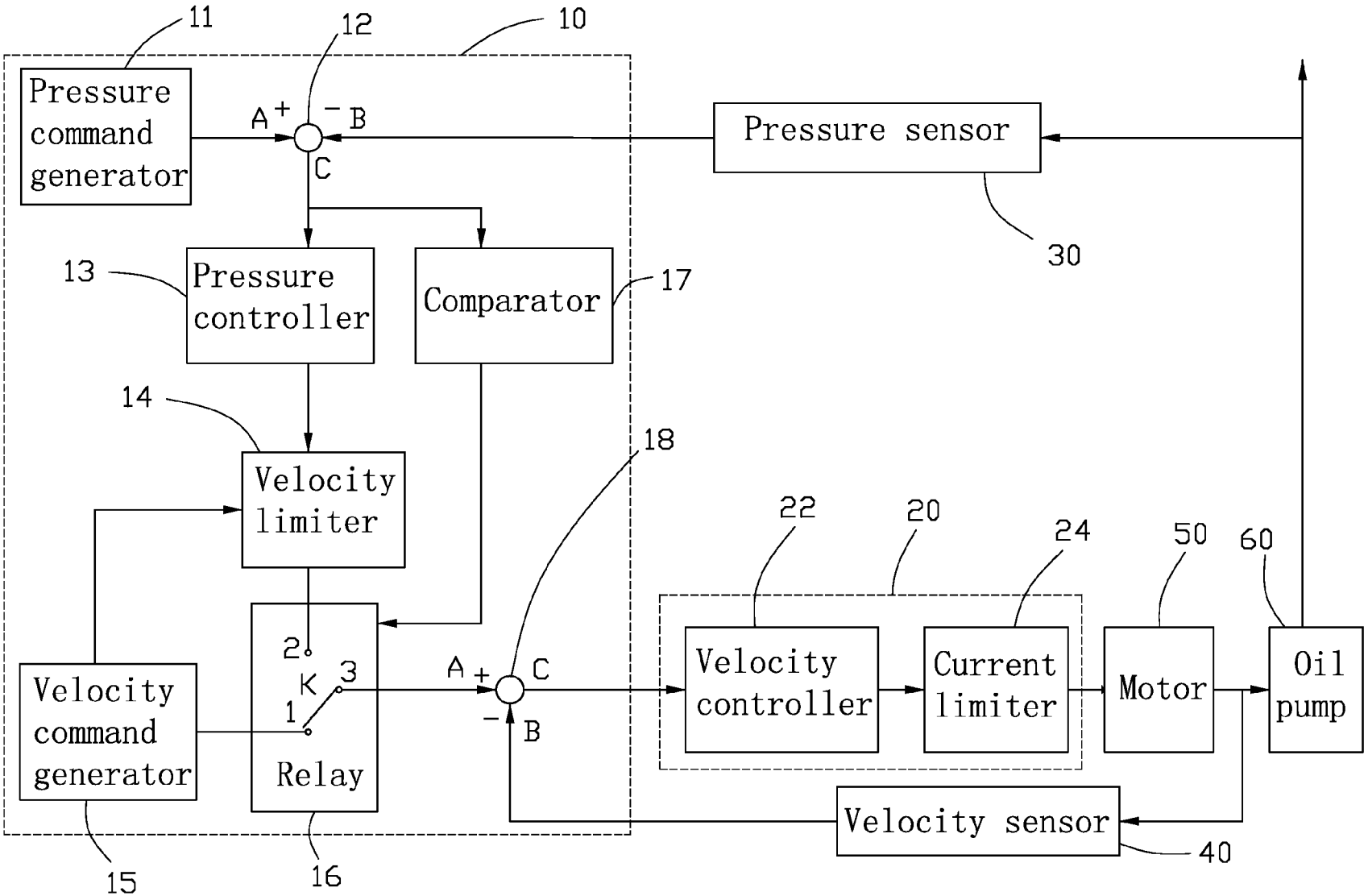
FIG. 2 is a detailed block diagram of FIG. 1.

Referring to FIGS. 1 and 2, an exemplary embodiment of a velocity-pressure control apparatus is configured for controlling a motor 50 to control a hydraulic pump, such as an oil pump 60 of a hydraulic machine, such as a hydraulic injection molding machine. The velocity-pressure control apparatus includes a velocity-pressure switch module 10, a motor driver 20, a pressure sensor 30, and a velocity sensor 40. The velocity-pressure switch module 10 is connected to the motor 50 via the motor driver 20.

The velocity-pressure switch module 10 includes a pressure command generator 11, a first comparison unit 12, a pressure controller 13, a velocity limiter 14, a velocity command generator 15, a switch such as a relay 16, a comparator 17, and a second comparison unit 18. In one embodiment, the relay 16 includes a single-pole double-throw (SPDT) switch K, and a control terminal to control the SPDT switch K. The SPDT switch K includes a first throw 1, a second throw 2, and a pole 3.

The pressure command generator 11 is configured for outputting a target pressure signal of the oil pump 60, and giving a desired pressure of the oil pump 60 to a positive terminal A of the first comparison unit 12. The pressure sensor 30 senses current pressure of the oil pump 60 and transmits a pressure sensing signal relaying the current pressure to a negative terminal B of the first comparison unit 12. The first comparison unit 12 outputs a pressure compensation signal via an output C, by subtracting the pressure sensing signal from the target pressure signal and sending the pressure compensation signal to an input of the pressure controller 13 and an input of the comparator 17.

The pressure controller 13 receives the pressure compensation signal and obtains a compensation velocity according to the pressure compensation signal, and then correspondingly outputs a compensation velocity signal to an input of the velocity limiter 14. The comparator 17 receives the pressure compensation signal. When the pressure compensation signal is a positive signal or a null signal, namely the current pressure of the oil pump 60 is less than or equal to the expectation pressure, the comparator 17 outputs a velocity control signal to the control terminal of the switch K to control the switch K to connect the pole 3 to the first throw 1. When the pressure compensation signal is a negative signal, namely the current pressure of the oil pump 60 is greater than the desired pressure, the comparator 17 outputs a pressure control signal to the control terminal of the switch K, to control the switch K to connect the pole 3 to the second throw 2.

The velocity command generator 15 is configured for outputting a predetermined velocity signal, giving a predetermined velocity, to the velocity limiter 14. An output of the velocity limiter 14 is connected to the second throw 2 of the switch K. The velocity limiter 14 compares the compensation velocity signal with the predetermined velocity signal, and outputs the smaller velocity signal as a limiting velocity command signal. The velocity command generator 15 is also configured for outputting a target velocity signal, giving a desired velocity to the first throw 1 of the switch K. When the pole 3 is connected to the second throw 2 of the switch K, the limiting velocity command signal is output to a positive terminal A of the second comparison unit 18. When the pole 3 is connected to the first throw 1 of the switch K, the target velocity signal is output to the positive terminal A of the second comparison unit 18.

The motor driver 20 includes a velocity controller 22 and a current limiter 24. The velocity sensor 40 senses a current velocity of the motor 50 and transmits a corresponding velocity sensing signal to a negative terminal B of the second comparison unit 18. The second comparison unit 18 outputs a velocity compensation signal via an output C, by subtracting the velocity sensing signal from the target velocity signal and sending the velocity compensation signal to an input of the velocity controller 22. The velocity controller 22 processes the velocity compensation signal and then drives the motor 50 via the current limiter 24.

In use, the velocity-pressure control apparatus works at a velocity control mode at first, wherein the pole 3 is connected to the first throw 1 of the switch K. At this time, the motor driver 20 receives the velocity compensation signal from the second comparison unit 18, so as to control acceleration of the motor 50 such that the pressure of the oil pump 60 increases. At the same time, the comparator 17 receives the pressure compensation signal from the first comparison unit 12. If the pressure compensation signal is a positive signal or a null signal, the velocity-pressure control apparatus continues to work at the velocity control mode. If the pressure compensation signal is a negative signal, the comparator 17 outputs the pressure control signal to control the switch K to connect the pole 3 to the second throw 2. The motor driver 20 receives the velocity compensation signal from the second comparison unit 18, so as to control deceleration of the motor 50 such that the pressure of the oil pump 60 decreases. Therefore, the velocity-pressure control apparatus works at a master pressure control and slave velocity control mode.

Because the motor 50 and the oil pump 60 works at the velocity control mode when the pressure of the oil pump 60 increases, the motor 50 is rotated at a very fast velocity in this period, which can reduce time for increasing the pressure of the oil pump 60. Because the motor 50 and the oil pump 60 works at the master pressure control and slave velocity control mode when the pressure is reduced, the velocity of the rotation of the motor 50 can be limited, which can avoid shaking of the hydraulic machine.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A control apparatus for controlling velocity of a motor and pressure of a hydraulic pump of a hydraulic machine, the control apparatus comprising:

a pressure command generator configured for outputting a target pressure signal, and giving a desired pressure of the hydraulic pump;

a first comparison unit connected to the pressure command generator to receive the target pressure signal;

a pressure sensor configured for sensing current pressure of the hydraulic pump and transmitting a pressure sensing signal indicative of the sensed current pressure to the first comparison unit, wherein the first comparison unit outputs a pressure compensation signal by subtracting the pressure sensing signal from the target pressure signal;

a pressure controller configured for receiving the pressure compensation signal and obtaining a compensation velocity according to the pressure compensation signal, and correspondingly outputting a compensation velocity signal;

a velocity command generator configured for outputting a predetermined velocity signal, and a target velocity signal;

a velocity limiter configured for receiving the compensation velocity signal and the predetermined velocity signal to output a corresponding limiting velocity command signal, wherein the limiting velocity command signal is the smaller one of the compensation velocity signal and the predetermined velocity signal;

a second comparison unit comprising an output;

a switch comprising a first terminal configured for receiving the target velocity signal, a second terminal for receiving the limiting velocity command signal, a third terminal connected to the second comparison unit, and a control terminal;

a comparator connected between the output of the first comparison unit and the control terminal of the switch, configured for receiving the pressure compensation signal to control the third terminal of the switch to connect to the first terminal of the switch when the pressure compensation signal is a positive signal or a null signal, and to control the third terminal of the switch to connect to the second terminal of the switch when the pressure compensation signal is a negative signal;

a velocity sensor configured for sensing a current velocity of the motor and transmitting a corresponding velocity sensing signal to the second comparison unit, wherein the second comparison unit outputs a velocity compensation signal by subtracting the velocity sensing signal from the target velocity signal; and a motor driver connected between the output of the second comparison unit and the motor to drive the motor according to the velocity compensation signal.

2. The control apparatus of claim 1, wherein the motor diver comprises a velocity controller and a current limiter, an input of the velocity controller is connected to the output of the second comparison unit, an output of the velocity controller is connected to the motor via the current limiter.

3. The control apparatus of claim 1, wherein the switch comprises a relay, the relay comprising a single-pole double-throw (SPDT) switch having a first throw, a second throw, and a pole corresponding to the first, second, and third terminals of the switch.

4. A velocity-pressure switch module for controlling velocity and pressure of a hydraulic machine, the velocity-pressure switch module comprising:

a pressure command generator configured for outputting a target pressure signal, and giving a desired pressure of a hydraulic pump of the hydraulic machine;

a first comparison unit comprising a positive terminal connected to the pressure command generator to receive the target pressure signal, a negative terminal configured to connected to the hydraulic machine to receive a pressure sensing signal according to a current pressure of the hydraulic machine, and an output for outputting a pressure compensation signal by subtracting the pressure sensing signal from the target pressure signal;

a pressure controller configured for receiving the pressure compensation signal and obtaining a compensation velocity according to the pressure compensation signal, and correspondingly outputting a compensation velocity signal;

a velocity command generator configured for outputting a predetermined velocity signal, and a target velocity signal;

a velocity limiter configured for receiving the compensation velocity signal and the predetermined velocity signal to output a limiting velocity command signal, wherein the limiting velocity command signal is the smaller one of the compensation velocity signal and the predetermined velocity signal;

a second comparison unit comprising a positive terminal, a negative terminal, and an output;

a switch comprising a first terminal connected to the velocity command generator configured for receiving the target velocity signal, a second terminal connected to the velocity limiter configured for receiving the limiting velocity command signal, a third terminal connected to the positive terminal of the second comparison unit, and a control terminal, wherein the negative terminal of the second comparison unit is configured for receiving a velocity sensing signal indicative of a current velocity of the hydraulic machine, wherein the output of the second comparison unit outputs a velocity compensation signal by subtracting the velocity sensing signal from the target velocity signal;

a motor driver connected between the output of the second comparison unit and the motor to drive the motor according to the velocity compensation signal; and a comparator connected between the output of the first comparison unit and the control terminal of the switch, configured for receiving the pressure compensation signal to control the third terminal to connect to the first terminal of the switch when the pressure compensation signal is a positive signal or a null signal, and to control the third terminal to connect to the second terminal of the switch when the pressure compensation signal is a negative signal.

5. The velocity-pressure switch module of claim 4, wherein the switch comprises a relay, the relay comprises a single-pole double-throw (SPDT) switch having a first throw, a second throw, and a pole corresponding to the first, second, and third terminals of the switch.

* * * * *